United States Patent [19]

Brooks, Jr.

[11] 4,218,062

[45] Aug. 19, 1980

[54] METHOD OF PROPELLING A GAME PLAYING PIECE

[76] Inventor: Clyde Brooks, Jr., 49 W. 94 St., New York, N.Y. 10025

[21] Appl. No.: 4,005

[22] Filed: Jan. 16, 1979

Related U.S. Application Data

[63] Continuation-in-part of Ser. No. 950,791, Oct. 12, 1978, abandoned.

[51] Int. Cl.[3] ..... A63B 67/14

[52] U.S. Cl. ..... 273/108; 273/126 R; 273/128 R; 280/87.04 R

[58] Field of Search ..... 273/95 H, 128 R, 1 R, 273/86 R, 146, 108, 126 R, 67 R, 129 R, 168; D21/210; 35/13; 46/40

[56] References Cited

U.S. PATENT DOCUMENTS

| | | | |
|---|---|---|---|
| 2,219,905 | 10/1940 | Prickman | 280/12 B |
| 3,118,675 | 1/1964 | Lyle | 273/108 |
| 3,693,998 | 9/1972 | Cummins | 272/1 R |
| 4,029,330 | 6/1977 | Runyan, Jr. | 280/87.04 A |

*Primary Examiner*—Richard C. Pinkham
*Assistant Examiner*—T. Brown
*Attorney, Agent, or Firm*—Vincent P. Pirri; Arnold B. Christen

[57] ABSTRACT

A rollable game playing piece, and a method of an individual utilizing the playing piece in playing games. A rigid body disc has a top surface provided as a friction surface, and has a number of casters or the like affixed inside and upwardly of its bottom for mounting the body disc so that it is stable and freely rollable over a flat surface. The playing piece has a substantially non-planar hemispheric profile across the entire top thereof. An individual engages the top friction surface with one of his feet, and propels the playing piece toward a net by flexing his leg at the knee and/or hip to apply a force to the playing piece, and then releasing engagement of his foot with the top surface of the playing piece.

3 Claims, 6 Drawing Figures

FIG. 1
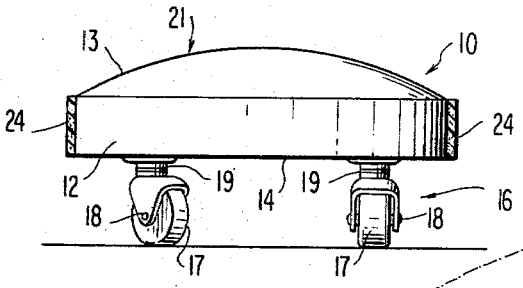
FIG. 2
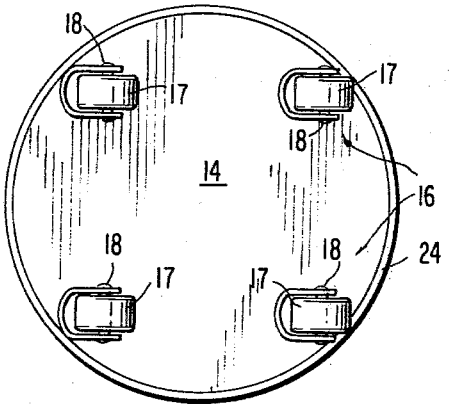
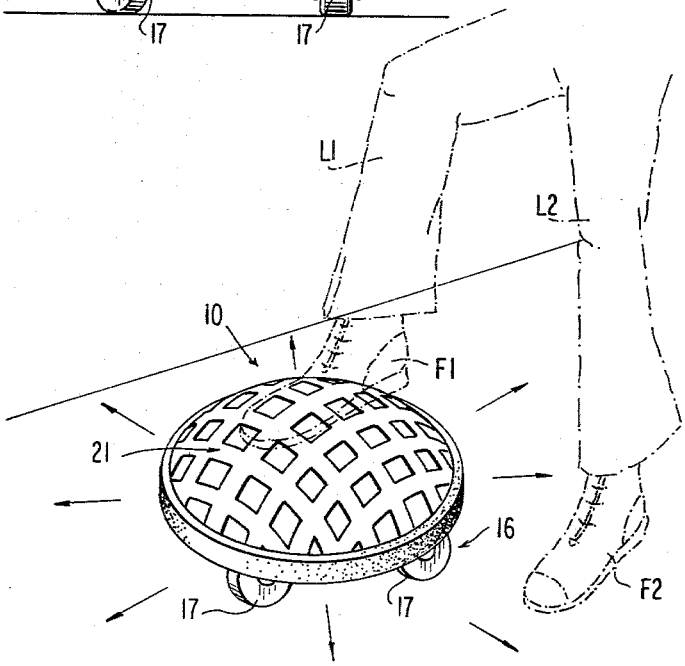
FIG. 3
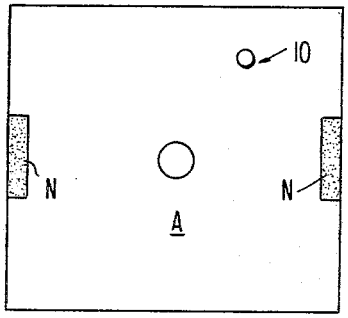
FIG. 4
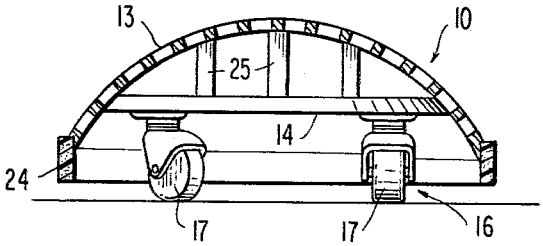
FIG. 5
FIG. 6
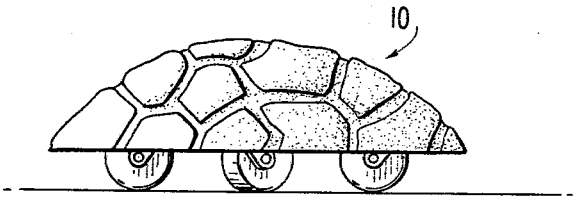

METHOD OF PROPELLING A GAME PLAYING PIECE

This application is a continuation-in-part application of applicant's copending application Ser. No. 950,791, which was filed on Oct. 12, 1978 (abandoned).

BACKGROUND AND SUMMARY OF THE INVENTION

The invention relates to a new method of an individual utilizing the rollable game playing piece during playing of the game. The game is similar to soccer in many respects, although the number of players, particular rules, and configuration of the goal lines and nets may be readily adapted to accomodate the environment in which the game is played and the preferences of the individuals playing the game.

The only piece of equipment utilized in the game is the rollable game playing piece which is moved by the players toward "nets" at opposed ends of the playing area. Optionally, the players can wear protective gear around their ankles or on their legs, e.g., foam rubber anklet pads, plastic shinguards, knee guards, etc. The game playing piece comprises a rigid body disc having substantially hemispheric, turtleback top portion and a bottom portion. Associated with the bottom portion are universally movable means, such as four symmetrically spaced casters, for mounting the body disc so that it is stable and freely rollable in any direction over a flat surface when a force having a component substantially parallel to the flat surface is applied thereto. Friction surface means are provided, and substantially completely encompass the hemispheric, turtleback top portion. Such means include a rubber mat surface, a rough spray-on surface, an integrally molded friction surface, or the like, for providing a friction surface so that an individual may securely engage and control the movement of the body disc by placing one of the individual's feet on the friction surface. The playing piece has a substantially hemispherical or turtleback profile across the top portion thereof.

Preferably the playing piece is dimensioned so that the foot or shoe contact area of the top surface is of a size and shape such that it is impractical for an individual using the playing piece to put both feet on the top surface at the same time while playing the game according to the invention. While the playing piece is thus not not designed to be "ridden", it must have sufficient strength to support the weight of the individuals playing the game since an individual may place one foot on the friction surface and pump with the other foot (alternately moving it into and out of contact with the playing area surface) to propel the playing piece along the playing surface toward one of the nets. The body disc will normally be circular with a diameter of about 8 to 12 inches. Further, an impact absorbing material is preferably disposed around the perimeter of the body disc adjacent the bottom surface thereof so that should the playing disc impact a person's foot or leg, the probability of bruising is reduced.

In utilizing the rollable game playing piece in playing a game, an individual will normally engage the top friction surface of the rigid body disc with one of his feet, and propel the playing piece toward one of the nets, rolling on the surface forming the playing area, by moving his leg by flexing of the leg at the knee and/or hip and applying a force to the playing piece, and then removing the foot from the playing piece after the force is applied. Alternately, the individual may propel the playing piece by maintaining one foot in engagement with the friction surface and pumping with the other leg (as described above), and/or by impacting the body disc with the toe, instep, or sole of the individual's foot to propel the playing piece toward the net.

It is the primary object of the present invention to provide a rollable game playing piece, and a method of utilization thereof, facilitating the playing of an enjoyable game on a playing area having a hard substantially planar non-slippery horizontal surface. This and other objects of the invention will become clear from an inspection of the detailed description of the invention, and from the appended claims.

BRIEF DESCRIPTION OF THE DRAWINGS

FIG. 1 is a sectional view of an exemplary rollable game playing piece according to the invention;

FIG. 2 is a bottom plan view of the playing piece of FIG. 1;

FIG. 3 is a perspective view indicating a method of utilization of the playing piece of FIG. 1 when playing a game;

FIG. 4 is a top plan view of an exemplary playing area on which a game utilizing the playing piece of FIG. 1 may be played;

FIG. 5 is a sectional view of a preferred form of the rollable game piece according to the invention; and FIG. 6 is a side view showing an integrally molded friction top surface in the form of a soccer ball or turtleback surface. In FIG. 6, the profile of the body disc becomes progressively thinner as the turtleback top portion and the bottom portion approach each other to form the outer perimeter thereof whereas the body disc becomes progressively thicker towards its center, e.g., about two inches.

DETAILED DESCRIPTION OF THE INVENTION

An exemplary rollable game playing piece according to the present invention is shown generally at 10 in the drawings. The playing piece 10 comprises a rigid body disc 12 having substantially hemispherical or turtleback top portion 13 and a bottom portion 14, respectively. The body disc 12 may be formed of plywood, metal, fiberglass, or various plastics such as high impact polystyrene, polyethylene, polypropylene, polyurethane, or polyester. Desirably, the profile of body disc 12 will be relatively thin at its perimeter, e.g., about one inch thick or less, and two to three inches thick at the center area. The material of which it is constructed should be strong enough to support the weight of the individuals who will be playing the game with the playing piece 10. The area of the hemispherical top surface 13 is preferably of such a size and shape that it is impractical for an individual using the playing piece to put both feet on the hemispherical or turtleback top surface 13 at the same time while playing the game. If the playing piece 10 is designed to be used by young children, it can be of relatively light construction, and be formed as a circle having a diameter of about 8 to 10 inches. For use by older children or adults, the playing piece 10 would be made of relatively heavier construction and have a diameter of about 12 inches. In general, a diameter of about 8 to 12 inches is suitable.

The playing piece 10 further comprises universally movable means 16 associated with the bottom portion 14 thereof for mounting the disc 12 so that it is stable and freely rollable in any direction over a flat surface when a force having a component substantially parallel to the flat surface is applied thereto. The means 16 may take the form of casters, ball bearings, universally swivelable wheels, or the like which provide for ready rolling and are relatively friction free. In FIG. 2, means 16 takes the form of four casters mounted symmetrically on the bottom 14 to provide stability to the playing piece 10, each caster having a wheel component 17 mounted for rotation about both a horizontal and a vertical axis, the horizontal axis being provided by horizontal pivot pins 18 or the like, and the vertical axis being provided by rotatable shaft 19 or the like which is mounted for rotation (as by a conventional ball bearing and collar arrangement) to the bottom surface 14.

In a preferred form, the game playing piece 10 is constructed so as to be close to the playing surface. As shown in FIG. 5, the casters 17 are imbedded in and under the piece 10 and the turtleback top 13 is positioned as lowered over the casters. Also, it is preferrable to provide support members 25 between the hemispheric surface 13 and the base portion 14.

The playing piece 10 further comprises means 21 associated with and substantially completely encompassing (see FIGS. 1 and 3) the top surface 13 for providing a friction surface to enable an individual to securely engage and control the movement of body disc 12 by placing one of the individual's feet on the friction surface. The means 21 as shown in FIGS. 1 and 3 takes the form of an integral rough top surface which is corrugated, checkered, or in the form of a soccer ball surface, or the like. However, such friction surface can take a wide variety of other forms such as mats made of resilient material in general, a rough texturing of the top surface 13 of the material forming the disc 12, spray on rough or sticky surfaces, or the like. Even with the means 21 forming the friction surface, the playing piece 10 has a substantially hemispherical turtleback profile across the entire top thereof (see FIGS. 1 and 6) so than an individual playing the game has free access to the friction surface unhampered by the sides of the body disc 12, as well as having free access to the perimeter of the body disc 12.

In order to reduce the possibility of bruising of the players' feet and legs should they be impacted by the playing piece 10, and in order to minimize damage to the playing piece 10 itself, or physical structures which it might impact, preferably an impact absorbing material 24 is disposed around the perimeter of the body disc 12 thereof. The impact absorbing material 24 is shown in FIG. 1 with the portions of it at the left and right hand sides of the disc 12 in FIG. 1 cut away so that the body disc 12 itself may be seen in FIG. 1. However, it is to be understood that normally the impact absorbing material 24 would be disposed around the entire periphery of the disc 12. Suitable substances for forming the material 24 include conventional foams and rubber.

Method

The rollable game playing piece 10 having been described, an exemplary method of utilization thereof for playing a game will now be set forth, with particular reference to FIGS. 3 and 4.

The method comprises the steps of providing a playing area A (see FIG. 4) with a hard substantially planar non-slippery horizontal surface (such as cement, asphalt, dirt, or the like) over which the playing piece is adapted to roll, with a "net" N provided on the playing area A; engaging the top friction surface 21 of the rigid body disc 12 with one of the individual's feet F1; and propelling the playing piece toward the net N. The term "net" as used in the specification and claims is not intended to be restricted to an actual mesh type structure, but in intended to encompass all structures providing a predefined goal area. The game normally being played will have rules substantially similar to soccer, and preferably a pair of nets N are provided disposed at a opposed ends of the playing area A.

Propelling of the playing piece toward a net N, rolling on the horizontal surface (A), is accomplished by movement of the individual's leg L1 whose foot F1 is in engagement with the friction top surface 21 of the body disc 12, by flexing of the leg L1 at the knee and/or hip and applying a force to the playing piece, and removing the foot from the playing piece after the force application. With particular reference to FIG. 3, it will be seen that the individual may maintain the foot F2 in contact with the ground while engaging the friction surface 21 with the foot F1, and applying a force downwardly and/or laterally on the playing piece 10, and then by merely moving the leg L1 (by flexing at the knee and/or hip) the playing piece 10 may be propelled in any direction, such as indicated by the directional arrows in FIG. 3. Thus, the playing piece 10 can be passed from one player to another, or propelled directly at a net A.

As an alternative to propelling the playing piece as described above, during playing of a game utilizing the playing piece 10, the individual may maintain one of his feet, F1, in engagement with the friction top surface 21 while propelling the playing piece 10 toward a net N by pumping with the individual's leg L2 whose foot F2 is not in engagement with a friction top surface 21, the foot F2 not in engagement with the friction top surface 21 alternately being moved into and out of contact with the playing area surface. Depending upon the rules of the game actually being played, this manner of propelling the playing piece 10 can be legal or illegal. Normally, as mentioned above, the size of the surface 13 is selected so that it is impractical during the playing of the game for an individual to place both feet F1, F2, on the friction surface 21 since "riding" of the playing piece 10 is to be discouraged due to the possibility of injury to an individual falling off of the playing piece 10 when being contacted by another player, and because the maximum enjoyment of the game is normally achieved when the playing piece 10 is relatively small and can be moved about in a manner similar to movement of a soccer ball.

As an alternative manner of propelling the playing piece 10, it may be propelled by an individual impacting the body disc 12 (either on or partially on the friction surface 21, or at the perimeter of the disc 12) with the toe, instep, or sole of the individual's foot.

As previously mentioned, the game played utilizing the playing piece 10 will normally have basically the same rules as soccer, although elements of soccer, hockey, and basketball may be combined in the drafting of the rules, and the number of players, size of the playing area A, configuration of the nets N, and the like may be varied depending upon the particular environment and the preferences of the individuals playing the game.

Thus, it will be seen that according to the present invention a novel rollable game playing piece has been provided which facilitates the playing of games similar to soccer on hard, substantially planar playing areas, and a method of utilization thereof has been provided which provides a good deal of enjoyment and exercise to the individuals playing the game. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of an individual utilizing a rollable game playing piece comprising a substantially circular rigid body disc with a hemispheric friction upper portion and supporting rolling means on the bottom portion, said method comprising the steps of (a) providing a playing area with a hard substantially planar non-slippery horizontal surface over which the playing piece is adapted to roll, with a net provided on said playing area, (b) engaging the top friction surface of the rigid body disc with one of the individual's feet, and (c) propelling the playing piece toward the net, rolling on the horizontal surface, by movement of the individual's leg whose foot is in engagement with the friction top portion of the body disc by flexing of the leg at the knee and/or hip and applying a force to the playing piece, and removing the foot from the playing piece after the force application.

2. A method as recited in claim 1 comprising the further step of alternately with step (c), maintaining the individual's one foot in engagement with the friction top portion of the body disc while propelling the playing piece toward the net by pumping with the individual's leg whose foot is not in engagement with the friction top portion, the foot not in engagement with the friction top portion alternately being moved into and out of contact with the playing area surface.

3. A method as recited in claim 1 or claim 2 comprising the further step of alternately with step (c), impacting the body disc with the toe, instep, or sole of the individual's foot to propel the playing piece toward the net.

* * * * *